US005164280A

United States Patent [19]

Texter et al.

[11] Patent Number: 5,164,280

[45] Date of Patent: Nov. 17, 1992

[54] MECHANICOCHEMICAL LAYER STRIPPING IN IMAGE SEPARATION SYSTEMS

[75] Inventors: John Texter, Rochester; William B. Travis, Holcomb; Roland G. Willis, Rochester, all of N.Y.

[73] Assignee: Eastman Kodak Company, Rochester, N.Y.

[21] Appl. No.: 805,717

[22] Filed: Dec. 6, 1991

[51] Int. Cl.[5] ..... G03C 8/50; G03C 11/12

[52] U.S. Cl. ..... 430/202; 430/235; 430/256; 430/404

[58] Field of Search ..... 430/256, 237, 248, 404, 430/206, 202, 244, 236, 235, 961

[56] References Cited

U.S. PATENT DOCUMENTS

| | | | |
|---|---|---|---|
| 3,677,753 | 7/1972 | Francis et al. | 430/206 |
| 3,771,871 | 11/1973 | Rattman | 355/102 |
| 3,793,023 | 2/1974 | Land | 430/212 |
| 4,222,070 | 9/1980 | Howe et al. | 358/128.5 |
| 4,347,300 | 8/1982 | Shimazu et al. | 430/156 |
| 4,359,518 | 11/1982 | Hanselman et al. | 430/248 |
| 4,401,746 | 8/1983 | Pfingston | 430/236 |
| 4,519,689 | 5/1989 | Kinsman et al. | 354/304 |
| 4,529,683 | 7/1985 | Bishop | 430/236 |
| 4,530,896 | 7/1985 | Christensen et al. | 430/256 |
| 4,544,619 | 10/1985 | Christensen et al. | 430/256 |
| 4,554,238 | 11/1985 | Bushman | 430/258 |
| 4,617,251 | 10/1986 | Sizensky | 430/256 |
| 4,632,872 | 12/1986 | Gallagher et al. | 428/350 |
| 4,668,602 | 5/1987 | Hosaka et al. | 430/207 |
| 4,740,496 | 4/1988 | Vanier | 503/227 |
| 4,871,648 | 10/1989 | Bowman et al. | 430/215 |

FOREIGN PATENT DOCUMENTS 59-087457 5/1984 Japan .

*Primary Examiner*—Charles L. Bowers, Jr.
*Assistant Examiner*—Mark F. Huff
*Attorney, Agent, or Firm*—Paul A. Leipold

[57] ABSTRACT

The invention is generally accomplished by a method wherein a dry photographic image is formed in an imaging-forming donor layer. The formed image is allowed to diffuse to a receiver layer. A dry acceptor layer is brought into contact with the image-forming layer and then separated such that the image-forming layer is adhered to the acceptor layer. It is preferred that the contact of the acceptor layer and the image-forming layer is under heat and pressure and the preferred material for both layers is dry gelatin.

35 Claims, 1 Drawing Sheet

MECHANICOCHEMICAL LAYER STRIPPING IN IMAGE SEPARATION SYSTEMS

TECHNICAL FIELD

The present invention relates to photographic imaging. It particularly relates to a system wherein an imaging layer is stripped after diffusion transfer of the image to a receiving layer.

PRIOR ART

Procedures for preparing photographic images in silver by diffusion transfer principles are well known in the art. For the formation of positive silver images, a latent image contained in an exposed photosensitive silver halide emulsion is developed, and almost concurrently therewith a soluble silver complex is obtained by reaction of a silver halide solvent with unexposed and undeveloped silver halide of said emulsion. The photosensitive silver halide emulsion is developed with a processing composition which may be spread between the photosensitive element comprising the silver halide emulsion and a second element which may comprise a suitable silver precipitating layer. The processing composition effects development of the latent image in the emulsion, and, substantially contemporaneous therewith, forms a soluble silver complex, for example, a thiosulfate or thiocyanate, with undeveloped silver halide. This soluble silver complex is at least in part transported in the direction of the print receiving layer, and the silver thereof is precipitated in the silver precipitating element to form a positive image. Procedures of this description are disclosed, for example, in U.S. Pat. No. 2,543,181 issued to Edwin H. Land. See also Edwin H. Land, One Step Photography, Photographic Journal, Section A, pgs. 7-15, January 1950.

Additive color reproduction may be produced by exposing a photosensitive silver halide emulsion through an additive color screen having filter media or screen elements each of an individual additive color such as red or green or blue and by viewing the reversed or positive silver image formed by transfer to a transparent print receiving element through the same or a similar screen which is suitably registered with the positive image carried in the print receiving layer. As examples of suitable film structures for employment in additive color photography, mention may be made of U.S. Pat. Nos. 2,861,885; 2,726,154; 2,944,894; 3,536,488; 3,615,426; 3,615,427; 3,615;428; 3,615,429; and 3,894,871.

U.S. Pat. No. 4,359,518 — Hanselman et al. discloses a method wherein a stripping sheet is utilized to remove a photosensitive imaging layer from a diffusion transfer film unit after the image has been formed and transferred. This system has a disadvantage that it requires the system to be wet at the time of contacting the image layer to be removed with the stripping sheet. The wet system is a disadvantage in that the removed material is heavier, harder to store, and more difficult to handle. Further, the stripping sheet layer is required to have a permeability change which increases the difficulty of formation of that layer, as well as adding to the cost.

U.S. Pat. No. 3,677,753 — Francis et al. discloses a system for removal of an imaging layer in an instant motion picture film. This system has the disadvantages that it also is a wet system with the inherent disadvantages of such systems listed above, as well as having the disadvantage that the performance of the system is poor if there is poor adhesion between the layer being stripped to itself, as the layer is rolled upon itself and, therefore, requires such self adhesion.

U.S. Pat. No. 4,668,602 — Hosaka et al. discloses a peel-apart photographic system which contains stripping and delaminating elements.

DISCLOSURE OF THE INVENTION

An object of the invention is to provide an improved method for separation of donor layers from receiver layers in a photographic film unit.

Another object of the invention is to provide an improved method of accumulating spent imaging materials for recycling or disposal.

An additional object of the invention is to provide an improved method of separation of imaging materials from receiver layers.

These and other objects of the invention are generally accomplished by a method wherein a dry photographic image is formed in a donor-receiver element that includes an imaging-forming layer. The image formed in the image-forming layer is allowed to diffuse to a receiver layer. A removal element that includes a dry acceptor layer is brought into contact with the topmost layer of the dry donor-receiver element, bonded thereto and then separated such that the image-forming layer remains adhered to the acceptor layer. It is preferred that the bonding of the acceptor layer and the imageforming layer of the donor element is under heat and pressure.

MODES FOR CARRYING OUT THE INVENTION

The invention has numerous advantages over prior processes for stripping image-forming layers from receiver layers after diffusion transfer. The system is dry and, therefore, creates a lower volume of accumulated waste. Further, since it is dry, the system is cleaner and less subject to variabilities caused by uneven wetting and is simpler and cheaper to manufacture, as the water absorbing properties of the materials are not critical. The system also has the advantage that as the materials are dry, there is less volume and, therefore, a lower cost to recycle the stripped materials. The process of the invention is amenable to a continuous operation, as images are formed and transferred by diffusion, thereby freeing the consumer from the necessity of controlling stripping and providing proper disposal of stripped materials as in instant film. Further, by having stripping performed continuously as images are formed at a photo processor, there is less need for the consumer to properly dispose of materials or to come in contact with spent imaging materials that may contain chemistry that is difficult to properly dispose of. The method of the invention also has the advantage that it may be applied both to continuous sheets and to separate discrete sheets. These and other advantages of the invention will be apparent from the detailed description below.

Figure 1:
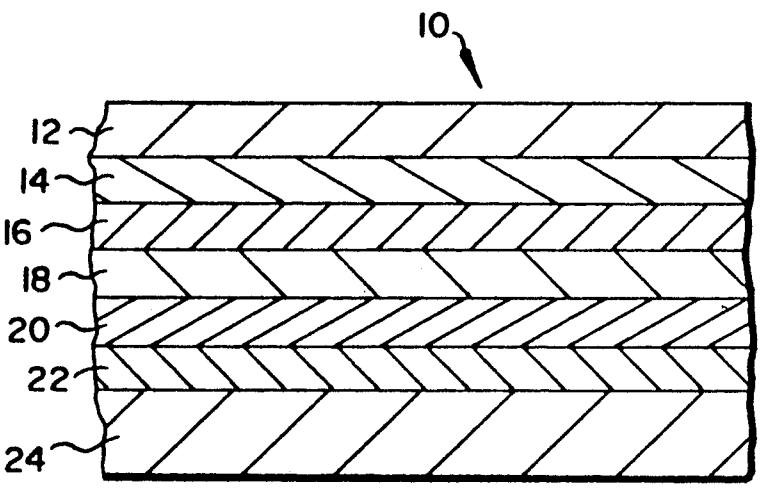
FIG. 1 illustrates in cross section a diffusion transfer film unit.

Illustrated in cross section in FIG. 1 is an integral image donor-receiver element 10 for utilization in the process of the invention. The element 10 is comprised of a top protective and transfer aiding layer 12. The protective layer 12 is optional and may not be required for some image-forming materials. Below the protective layer 12 are conventional imaging layers 14, 16, and 18. Layers 14, 16, and 18 conventionally would be blue, green, and red sensitive layers with appropriate dye-forming couplers that would result in a full color image formation. Below the lowermost of the image-forming layers, layer 20 is the stripping layer that provides an area of separation between the image-forming layers 14, 16, and 18, and the image-receiving layer 22. Layer 24 is a base support sheet for the image-forming layer.

Figure 2:
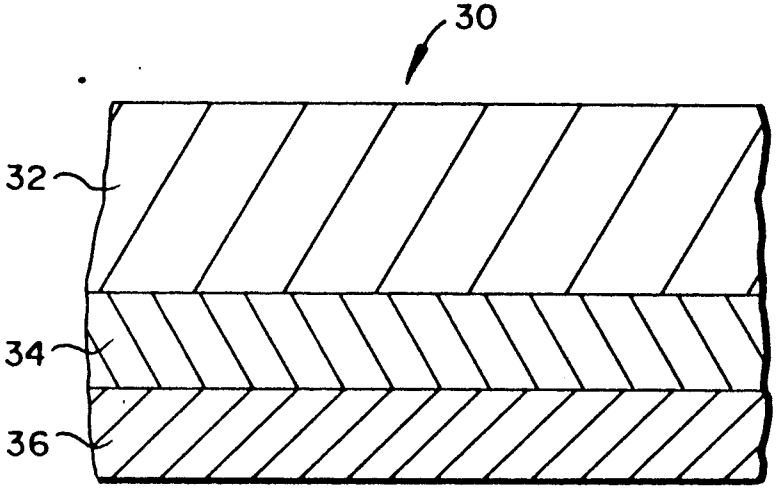
FIG. 2 illustrates in cross section an acceptor element for mechanicochemical layer stripping.

Illustrated in FIG. 2 is the removal element 30 for removal of the spent image-forming layers 14, 16, and 18. The removal element 30 is formed with a support 32 which carries an acceptor layer 36. The acceptor layer is attached to the support 32 by binder layer 34. Depending on the materials used to form the receiver element 30, the binder layer 34 may not be needed.

Figure 3:
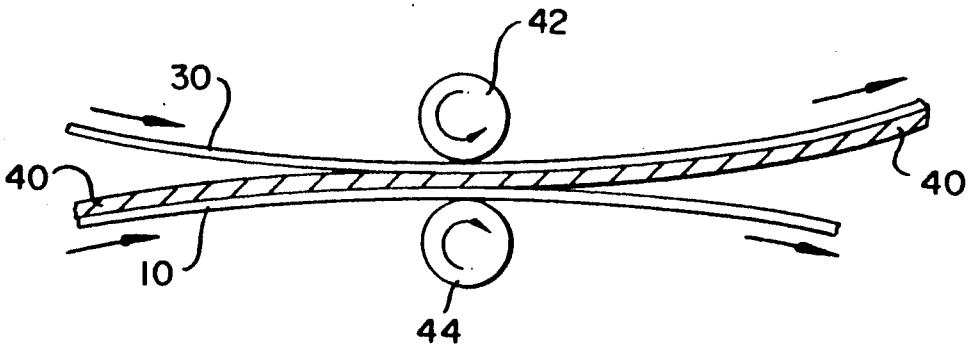
FIG. 3 illustrates schematically the process of the invention in which a spent imaging layer of a donor element is stripped by the removal element.

Illustrated schematically in FIG. 3 is the process of the invention in which the removal element 30 is brought into contact with the image donor-receiver element 10 at the nip between rollers 42 and 44. There under pressure of the nip between rollers 42 and 44, the layer 40 which is composed of the overcoat layer and imaging layers 14, 16, and 18 is transferred to the acceptor layer 36 of removal element 30. Rollers 42 and 44 also may be heated to aid in the transfer.

The protective element 12, if present, may be formed of any suitable material that will aid in the transfer of the imaging layers and also serve to protect the element prior to the transfer. The material preferred would be gelatin, although other polymeric materials utilized in the photographic arts are suitable. The material must be capable of adhering to the dry acceptor layer under pressure and optionally heat.

The imaging layers illustrated as 14, 16, and 18 may be any suitable photographic layers. Further, they may each be formed of several layers comprised of fast and slow emulsions or including interlayers between the imaging layers for different colors.

The stripping layer 20 may be any material that will facilitate transfer of the imaging dyes to the receiver layer 22, from the imaging layers as well as providing an area that will separate when the imaging layers are removed without damage to the image on the receiver layer 22. It may be that the stripping layer is not necessary if the separation between the imaging layers and the receiver layer can be accomplished without utilization of such a layer. Preferred materials for utilization in the stripping layer are adepic acid polyester and cellulose acid hydrogen phthalate.

The receiver layer 22 may be any material that will accept dyes being transferred from the imaging layer, as well as provide a desirable stable viewing surface for these dyes after separation. Suitable materials are polycarbonate polymers.

The base 24 for the integral imaging element may be any support material that has the properties of being chemically neutral and chemically stable. Suitable are the typical photographic base materials such as polyester films and resin-treated papers.

The acceptor layer 36 on removal element 30 may be any suitable material that will when dry adhere to imaging layers under pressure and optionally heat. The preferred material has been found to be dry gelatin. By dry gelatin, it is meant that the water content is less than about 15 percent. It is preferred that the water content be that typical of dry film gelatin or about 10 percent. Typically, the acceptor layer 36 and the protective layer 12 will "dry weld" together under heat and pressure and commonly will comprise identical or near identical materials. Gelatin is preferred for both acceptor layer 36 and protective layer 12.

The pressure rollers 42 and 44 may be formed of any material. It is important that the surfaces of these rollers be smooth so that no imperfections are induced into the image during the transfer. The rollers need to be capable of having a carefully controlled pressure applied to them. The pressure generally may be between 1 psi and about 1000 psi. Generally, the pressure required is such that a pressure of between 0.1 and about 500 pounds per square inch can be applied. It is preferred for the process that the pressure at the rollers be between about four pounds and 60 pounds per square inch at the nip. The pressure may comprise between about 5 and about 40 psi. The rollers also should be capable of being heated. Typically, the heat required is between about 18° and about 300° C. A preferred temperature for heat during transfer is between about 20° and about 150° C. for best transfer without deterioration of the image. The heat required generally is dependent both upon the materials being transferred and the speed that they are passing through the rollers.

The acceptor layer preferably is gelatin because of cost, ease of recycling, and neutrality to images transferred. However, it is possible that other adhesion material could be utilized. Generally, when gelatin is utilized, it is preferred that it be at about the same level of dryness as the imaging layer to be transferred. It is surprising that gelatin when dry is an effective acceptor layer. It is also surprising that it is a good transfer aiding layer to aid removal of the image-forming layers. Generally, the acceptor layer should be coated with between about 10 mg and 2000 mg/sq. $m^2$ of gelatin. A preferred amount is between about 50 and about 200 mg of dry gelatin per square meter for adequate transfer at lowest coat. The gelatin utilized in the acceptor layer generally may be any type. The gelatin may generally comprise less than 10 grams per square meter.

After separation, the removal element having the imaging layers adhered to it may be wound up on any suitable device for recycling.

The following example is intended to be illustrative and not exhaustive of the performance of the invention. Parts and percentages are by weight unless otherwise indicated.

EXAMPLES

EXAMPLES 1 & 2

Two donor-receiver elements of the structure illustrated in Table 1 were coated with Coupler 1 at a level of 540 mg/$m^2$, red-sensitized AgCl at 320 mg/$m^2$ of silver, and gelatin at 1600 mg/$m^2$ in the imaging donor layer. These coatings were not hardened. These elements were coated with Coupler 1 as imaging coupler. One of these elements (Coating #2) was coated with a gelatin interlayer at 580 mg/$m^2$. The support consisted of resin coated (backed) paper on which a polycarbonate receiver layer (4300 mg/$m^2$) was coated. These elements were exposed and then processed 45 seconds in developer A at 21° C., 45 seconds in 3% acetic acid (in 30 g/L sodium sulfate), 90 seconds in 30 g/L, sodium sulfate, and dried. The exposure and development produced a typical dye-scale in the yellow dye formed by coupling of oxidized CD-3 and Coupler 1. This dye was formed in the imaging layer of the donor element.

Sets of these processed strips were laminated to the gel subbed and the unsubbed side of gel subbed polyethylene terephalate (ESTAR ™) for heat activated thermal dye transfer and donor layer stripping. The structure of this subbed ESTAR element is depicted in Table 2. This structure consists of an ESTAR base, on which is coated a soft-binder coat comprising of a random copolymer derived by polymerizing a mixture of ethenic monomers, said mixture comprising 15 mol % methyl-2-propenoate (CAS registry #96-33-3), 83 mol % 1,1-dichloroethene (CAS registry #75-35-4), and 2 mol % N-[S-(dimethylamino)-1,1-dimethyl propyl]-2-propenamide at 110 mg/m$^2$ (15% methacrylate, 83% vinylidene chloride, and 2% aminopropyl acrylamide), and over which is coated approximately 75 mg gelatin/m$^2$ (note Table 2). These laminates were passed through a set of pinch rollers at 110° C., at a speed of 0.1 inch per second, and at a pressure of 22 psi. A significant fraction of the yellow dye image in Coating #1 diffused to the receiver element during this heating. The donor layers were removed in both coatings, although the removal was considerably cleaner and more uniform (essentially complete) in the case where the gel-subbed ESTAR was laminated to the donor layers. The completeness of the donor layer removal in the case where the gel-subbed side was laminated to the donor element is illustrated in Table 3 where x-ray fluorescence determinations of silver (as AgCl and as developed silver metal) were made before and after removal of the donor layers for the case of Coatings #1 and #2. The removal of donor layers can be judged to be complete on the basis that, to within experimental uncertainty (± 10 mg Ag/m$^2$), no silver remains on the receiver layers.

TABLE 1

Coating Structure of Donor/Receiver Test Coatings

| Coating | Example 1 | Example 2 |
|---|---|---|
| Imaging Layer | 540 mg Coupler 1/m$^2$<br>AgCl at 320 mg Ag/m$^2$<br>1600 mg Gelatin/m$^2$ | 540 mg Coupler 1/m$^2$<br>AgCl at 320 mg Ag/m$^2$<br>1600 mg Gelatin/m$^2$ |
| Gelatin Interlayer | None | 540 mg/m$^2$ |
| Polymeric Receiver | 4300 mg/m$^2$ | 4300 mg/m$^2$ |
| Support | Resin Coated Paper | Resin Coated Paper |

TABLE 2

Structure of Subbed ESTAR Support Used as Removal Element in Example 1

7 mil ESTAR
Binding copolymer at 110 mg/m$^2$
Gelatin at 75 mg/m$^2$

TABLE 3

Silver coverage (mg/m$^2$) as a function of step number for (Examples) Coatings #1 and #2 before and after removal of (imaging) donor layers by lamination with the gel-subbed side of the removal element described in Table 2

| Step | #1 Before | #1 After | #2 Before | #2 After |
|---|---|---|---|---|
| 1 | 299 | 0 | 235 | 0 |
| 2 | 285 | 8 | 249 | 0 |
| 3 | 300 | 0 | 264 | 0 |
| 4 | 294 | 0 | 273 | 1 |
| 5 | 309 | 0 | 273 | 0 |
| 6 | 316 | 4 | 274 | 0 |
| 7 | 310 | 0 | 267 | 0 |
| 8 | 305 | 0 | 292 | 3 |
| 9 | 310 | 0 | 271 | 0 |
| 10 | 321 | 0 | 274 | 0 |
| 11 | 316 | 0 | 279 | 2 |
| 12 | 315 | 0 | 284 | 0 |
| 13 | 322 | 9 | 271 | 0 |
| 14 | 324 | 6 | 285 | 5 |
| 15 | 316 | 0 | 284 | 0 |
| 16 | 314 | 3 | 261 | 0 |
| 17 | 316 | 0 | 265 | 0 |
| 18 | 316 | 9 | 284 | 0 |
| 19 | 300 | 0 | 272 | 0 |
| 20 | 311 | 0 | 273 | 12 |
| 21 | 321 | 0 | 269 | 0 |

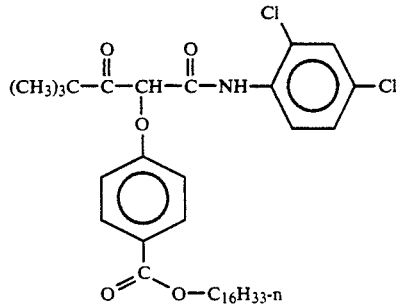

Coupler 1

| Developer A | |
|---|---|
| Triethanolamine | 12.41 g |
| Phorwite REU (Mobay) | 2.30 |
| 30% aqueous Lithium polystyrene sulfonate | 0.3 g |
| 85% aqueous N,N-diethylhydroxylamine | 5.40 g |
| Lithium sulfate | 2.70 g |
| KODAK Color Developing Agent CD-3 | 5.00 g |
| 1-Hydroxyethyl-1,1-diphosphenic acid (60% aqueous solution) | 1.16 g |
| $K_2CO_3$ | 21.16 g |
| $KHCO_3$ | 2.79 g |
| KCl | 1.60 |
| KBr | 0.007 g |
| pH at 80° F. | 10.04 ± 0.08 |
| Water to make 1 liter | |

The invention has been described in detail with particular reference to preferred embodiments thereof, but it will be understood that variations and modifications can be effected within the spirit and scope of the invention.

We claim:

1. A method of imaging comprising forming an image in at least one image-forming layer of a donor-receiver element, allowing said image to diffuse to a receiver layer in said donor-receiver element, bringing a dry acceptor layer of a removal element into contact with said donor-receiver element, and separating said removal element from said donor-receiver element such that said image-forming layer is adhered to said acceptor layer and wherein said acceptor layer comprises less than 15 percent by weight water.

2. The method of claim 1 wherein said image-forming layer contacts said removal element and said image forming layer comprises less than 15 percent by weight water.

3. The method of claim 1 wherein said acceptor layer comprises dry gelatin.

4. The method of claim 3 wherein said gelatin comprises between about 10 and 2000 milligrams per square meter.

5. The method of claim 3 wherein said acceptor layer comprises less than 10 percent water.

6. The method of claim 3 wherein the layer of said donor-receiver layer contacting said acceptor layer is a dry gelatin protective layer.

7. The method of claim 1 wherein said contact is under pressure and heat.

8. The method of claim 7 wherein said heat is between about 20° C. and about 200° C.

9. The method of claim 7 wherein said heat is between about 50 and about 150° C.

10. The method of claim 7 wherein said pressure comprises between 0.1 psi and about 500 psi.

11. The method of claim 10 wherein said pressure is between about 4 and about 60 psi.

12. The method of claim 1 wherein said image-forming layer comprises silver halide and photographically active materials.

13. The method of claim 12 wherein said photographically active materials are developable in aqueous solution.

14. The method of claim 1 wherein receiver layer comprises polycarbonate polymer or polyvinyl chloride.

15. The method of claim 1 wherein said contact is between pinch rollers.

16. The method of claim 1 wherein said donor-receiver element is dried after allowing said image to diffuse to said receiver layer.

17. The method of claim 1 wherein said acceptor layer comprises dry gelatin in an amount of less than 10 grams per square meter.

18. A method of imaging comprising forming an image in an imaging layer of a donor-receiver element, said donor-receiver element comprising an upper dry gelatin containing layer, allowing said image to diffuse to a receiver layer of said donor-receiver element, bringing a dry gelatin acceptor layer of a removal element into contact with the upper dry gelatin containing layer of said donor-receiver element with heating and pressure, and separating said donor-receiver element and said removal element such that said imaging layer is adhered to said acceptor layer and separates from said image receiver layer.

19. The method of claim 18 wherein said image is formed by dye-forming couplers.

20. The method of claim 19 wherein said imaging layer contains silver halide.

21. A method of delaminating donor-receiver layers in a dry donor-receiver photographic element, wherein said element comprises a plurality of image forming layers and an image receiving layer, said method comprising bringing a dry acceptor layer of a removal element into contact with said donor-receiver element, and separating said removal element from said donor-receiver element such that said image forming layers adhere to said acceptor layer, such that said image receiver layers are separated from said image forming layers, and wherein said acceptor layer comprises less than 15 percent by weight water.

22. The method of claim 21 wherein said image forming layer contacts said removal element and is less than 15 percent by weight water.

23. The method of claim 21 wherein said acceptor layer comprises gelatin.

24. The method of claim 23 wherein said acceptor layer comprises less than 10 percent water.

25. The method of claim 23 wherein said layer of said donor-receiver element contacting said acceptor layer is a dry gelatin protective layer.

26. The method of claim 23 wherein said gelatin comprises between about 10 and 2000 milligrams per square meter.

27. The method of claim 21 wherein said contact is under pressure and heat.

28. The method of claim 27 wherein said heat is between about 20° C. and about 200° C.

29. The method of claim 27 wherein said heat is between about 50° C. and about 150° C.

30. The method of claim 27 wherein said pressure comprises between 0.1 psi and about 500 psi.

31. The method of claim 30 wherein said pressure is between about 4 psi and about 60 psi.

32. The method of claim 21 wherein said image forming layer comprises silver halide and photographically active materials.

33. The method of claim 32 wherein said photographically active materials are developable in aqueous solution.

34. The method of claim 21 wherin said receiver layer comprises polycarbonate polymer or polyvinylchloride polymer.

35. The method of claim 21 wherein said contact is between pinch rollers.

* * * * *